US006512426B1

(12) United States Patent
Wixforth

(10) Patent No.: US 6,512,426 B1
(45) Date of Patent: Jan. 28, 2003

(54) INTEGRATED WAVEGUIDE COMPONENT

(75) Inventor: Thomas Wixforth, Hildesheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/646,495

(22) PCT Filed: Feb. 11, 1999

(86) PCT No.: PCT/DE99/00367

§ 371 (c)(1),
(2), (4) Date: Nov. 1, 2000

(87) PCT Pub. No.: WO99/49533

PCT Pub. Date: Sep. 30, 1999

(30) Foreign Application Priority Data

Mar. 21, 1998 (DE) ..... 198 12 582

(51) Int. Cl.[7] ..... H01P 1/18
(52) U.S. Cl. ..... 333/99.005; 333/161
(58) Field of Search ..... 333/161, 995

(56) References Cited

U.S. PATENT DOCUMENTS

| | | | | |
|---|---|---|---|---|
| 2,961,620 A | * | 11/1960 | Sommers | 333/161 |
| 3,146,413 A | * | 8/1964 | Butler | 333/161 |
| 3,656,179 A | * | 4/1972 | DeLoach | 333/161 |
| 3,737,810 A | | 6/1973 | Shelton | 333/116 |
| 5,616,538 A | | 4/1997 | Hey-Shipton et al. | 505/210 |
| 6,016,434 A | * | 1/2000 | Mizuno et al. | 333/995 X |
| 6,208,222 B1 | * | 3/2001 | Sinsky | 333/161 |

FOREIGN PATENT DOCUMENTS

| | | |
|---|---|---|
| CA | 1 264 073 | 12/1989 |
| DE | 24 53 851 A | 5/1976 |
| EP | 0 516 166 A | 12/1992 |
| EP | 0 743 695 A | 11/1996 |

OTHER PUBLICATIONS

Patent Abstract of Japan vol. 98, No. 5, Apr. 30 1998 & JP 10 004305 A (Furukawa Electric Co. Ltd), Jan. 6 1998.

Patent Abstract of Japan vol. 7., No. 170 (E–189), Jul. 27 1983 & JP 58 075901 A (Nippon Denki KK_ May 7, 1983.

* cited by examiner

*Primary Examiner*—Benny T. Lee
(74) *Attorney, Agent, or Firm*—Michael J. Striker

(57) ABSTRACT

An integrated waveguide component has at least one planar microwave conductor with at least one interruption point, a mechanically shiftable microwave conductor segment provided for each of the interruption points, a substrate plate above which the microwave conductor is disposed, a further substrate plate above which the microwave conductor segment is disposed, so that the microwave conductor segment is shiftable parallel to the substrate plate by displacement of the further substrate plate to establish or adjust an effective length, spanning the interruption point of the microwave conductor segment in accordance with the desired phased shift between an input signal are the output signal, the microwave conductor segment being disposed on a side remote from the microwave conductor of the further substrate plate, so that the further substrate plate performs not only a carrier function for the microwave conductor segment but simultaneously a function of a dielectric for an inductive and/or capacitive coupling of the microwave conductor to the microwave conductor segment.

8 Claims, 3 Drawing Sheets

INTEGRATED WAVEGUIDE COMPONENT

BACKGROUND OF THE INVENTION

The invention relates to an integrated waveguide component.

Integrated waveguide components of this generic type are known. They are used for instance in flat microwave antennas for transmitting and/or receiving signals. To achieve satisfactory signal transmission, and in particular to achieve good selectivity among different signals, such microwave antennas must be capable of orientation in two degrees of freedom to a counterpart location communicating with them. A counterpart location of this kind can for instance be a geostationary satellite. The two degrees of freedom are typically called "elevation" and "azimuth"; an angle $\Theta$ corresponds to the elevation and is located between a so-called main lobe direction of a primary plane of the antenna, while the azimuth $\phi$ characterizes the rotation of the entire assembly about a vertical axis. Depending on the location of a described coordinate system, however, other angle designations can also be selected. The known microwave antennas are not capable of receiving other than microwave signals striking their base surface perpendicularly, and an additional mechanical alignment is therefore indispensable.

Integrated waveguide components of this generic type are known. They are used for instance in flat microwave antennas for transmitting and/or receiving signals. To achieve satisfactory signal transmission, and in particular to achieve good selectivity among different signals, such microwave antennas must be capable of orientation in two degrees of freedom to a counterpart location communicating with them. A counterpart location of this kind can for instance be a geostationary satellite. The two degrees of freedom are typically called "elevation" and "azimuth"; an angle 9 corresponds to the elevation and is located between a so-called main lobe direction of a primary plane of the antenna, while the azimuth $\phi$ characterizes the rotation of the entire assembly about a vertical axis. Depending on the location of a described coordinate system, however, other angle designations can also be selected. The known microwave antennas are not capable of receiving other than microwave signals striking their base surface perpendicularly, and an additional mechanical alignment is therefore indispensable.

SUMMARY OF THE INVENTION

Accordingly, it is an object of the present invention to provide an integrated waveguide component which avoids the disadvantagages of the prior art.

The integrated waveguide component having the characteristics has the advantage of a simple, economical capability of achieving an adjustable phase shifter/monostable multivibrator. Because the at least one microwave conductor has at least one interruption point, and each of the interruption points is assigned a mechanically shiftable microwave conductor segment whose effective length spanning the interruption point is adjustable in accordance with a desired phase shift between the input signal and the output signal, it is advantageously possible in a simple way, namely by a purposeful mechanical shifting and ensuing fixation of the shiftable microwave conductor segment, to establish or adjust an intended phase shift. Depending on the maximum possible shift, which is dictated structurally, phase shifts can be established within relatively wide ranges.

In a preferred feature of the invention, it is provided that the microwave conductor has at least two planar contact paths, disposed above a ground plane, which are assigned a substantially U-shaped conductor segment that is displaceable longitudinally of the at least two contact paths. As a result, a phase shift by means of planar microwave conductors can be attained especially simply by means of by an extensible detourline (i.e. the principle of a trombone).

Since electronic phase shifters or monostable multivibrators capable of fast adjustment are not required for all applications, the apparatus according to the invention offers a simple, economical way of achieving an adjustable phase shifter (or monostable multivibrator) using planar microwave conduction technology.

In leaky wave antennas the integrated waveguide component can be used preferentially for adjusting or varying the main beam direction.

Other preferred applications of the mechanically adjustable planar phase shifters according to the invention are for instance planar microwave antennas for arbitrary types and directions of polarization. For instance, by means of a plurality of adjustable phase shifters, microwave antennas with an adjustable directional characteristic can advantageously be attained.

In a further preferred feature of the invention, it is provided that the microwave component is a resonator. In a simple way, this creates a resonator with an adjustable resonance length.

It is also preferred that the microwave component be a filter, in particular a superconducting filter. By variable adjustment of the effective length of the microwave conductor, the filter properties of the filter can be changed or set in a simple way.

BRIEF DESCRIPTION OF THE DRAWINGS

The invention will be described in further detail below in terms of exemplary embodiments in conjunction with the associated drawings.

DESCRIPTION OF THE PREFERRED EMBODIMENTS

Figure 1:
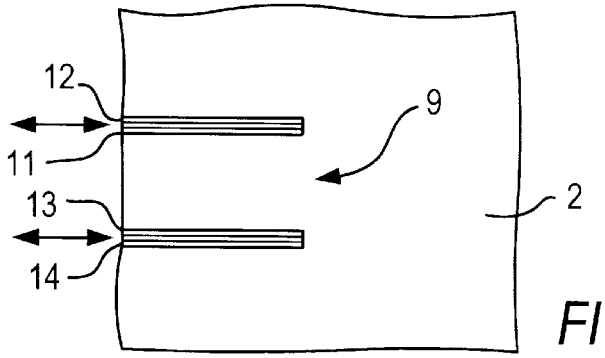
FIG. 1 is a schematic illustration of two conductors applied to a substrate.

FIG. 1 shows a schematic plan view of a conductor structure in planar microwave conductor technology, comprising two contact paths 12 and 14, mounted on a substrate plate 2 and located parallel to one another. The contact paths 12 and 14 are not connected to one another, so that an interruption point 9 is formed between them. Instead of a substrate plate 2, the contact paths 12 and 14 can also be applied to a superstrate plate or a superstrate foil. The contact paths 12 and 14 are applied by screen printing or the like, for instance, to the surface of the substrate plate 2 in such a way that galvanic contacting is made possible. The contact paths 12 and/or 14 can be acted upon with an input signal via a source, not shown, and an output signal can be picked up at the respective other contact path. A connection is made between the contact paths 12 and 14 as explained in further detail below. The contact path 12 has one input and output 11, and the contact path has an input and output 13.

Figure 2A:
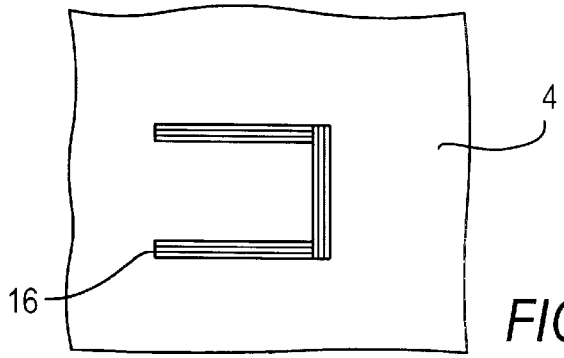
FIG. 2*a* is a schematic view of a displaceable. structure.
Figure 2B:
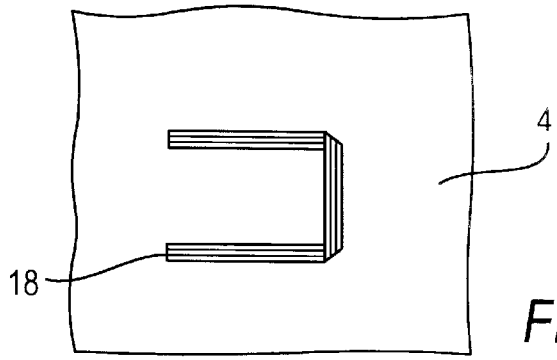
FIG. 2*b* is a schematic view of a displaceable structure in a modified embodiment.
Figure 2C:
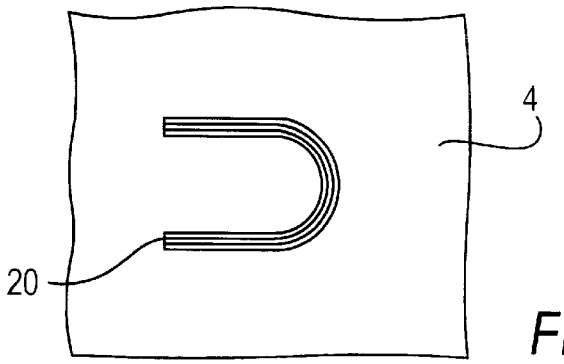
FIG. 2*c* is a schematic view of a displaceable structure in a further embodiment.

FIGS. 2*a*–2*c* in plan view show various embodiments of a substrate plate 4 with a planar, substantially U-shaped conductor track, hereinafter also called a U-shaped conductor segment. FIG. 2*a*, for instance shows a conductor track with well-defined edges of the legs of the U-shaped conductor segment 16. The edges of the conductor track of the U-shaped conductor segment 18 are flattened by a 45° cut, as shown in FIG. 2*b*. FIG. 2*c* shows an alternative form of a U-shaped conductor track or U-shaped conductor segment 20 with a half-round structure.

Figure 3:
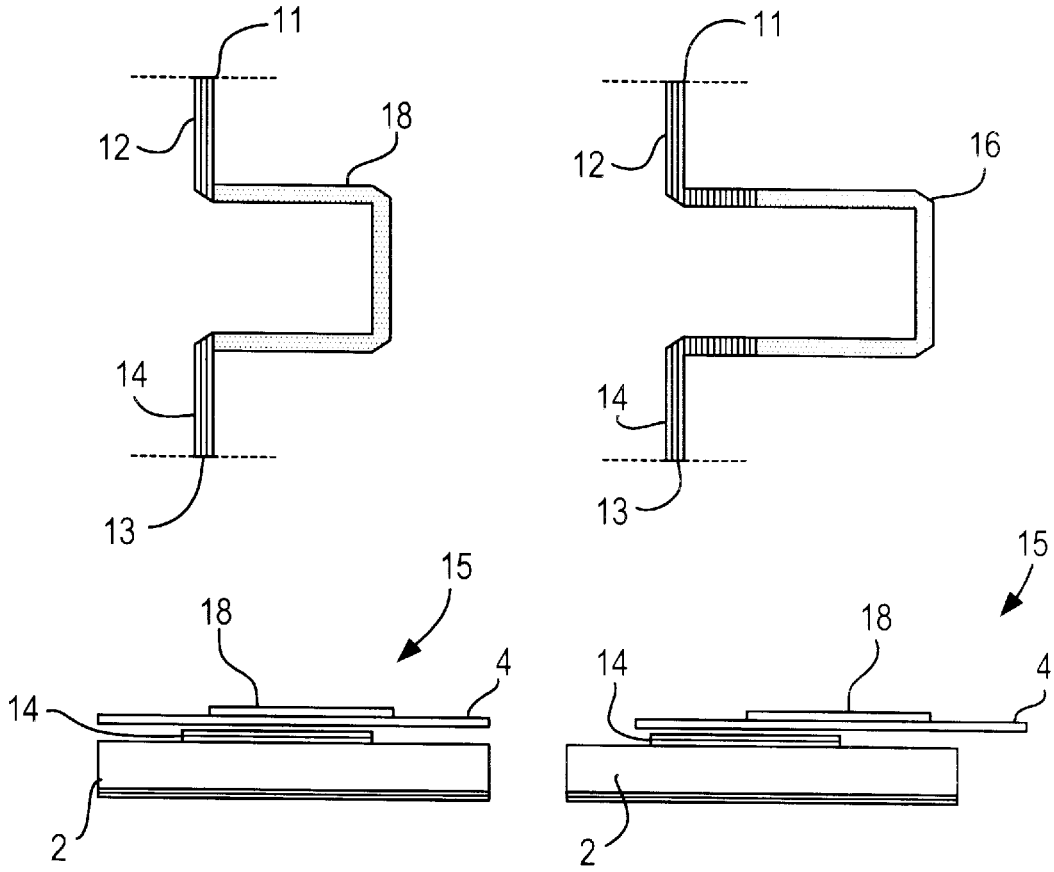
FIG. 3 is a schematic view of an embodiment employing microstrip conductor technology.

The two flat substrate plates 2 and 4, which are preferably approximately equal in area at their base, rest flat on one another in the intended state and form an integrated waveguide component 15 (FIG. 3). By displacing the substrate plates 2 and 4 relative to one another longitudinally of the contact paths 12 and 14, it is possible to set an effective length of a microwave conductor. The substrate plate 2 forms a ground plane and the substrate plate 4 an adjusting plane of the waveguide component 15. The assembled contact paths 12 and 14 and the U-shaped conductor segment 16, 18 or 20 form the total length of the microwave conductor. In a way similar to a trombone, for instance, a variable length of a detour line is lengthened or shortened by pulling out or pushing together or in other words shifting the conductor segment 16, 18 or 20 in the longitudinal direction of the contact paths 12 and 14. This makes it mechanically possible to establish or adjust a total length of a microwave conductor that comprises the contact paths 12 and 14 and one of the conductor segments 16, 18 or 20 (only segment 18 being shown in FIG. 3). In accordance with the set total length, a phase shift or propagation time adjustment of one or more microwave signals can be made between the inputs and outputs 11 and 13 of the waveguide component 15.

The planar microwave conductors can be embodied as a microstripline, triplate line, stripline, suspended-substrate line, slotline, coplanar line, or coplanar stripline.

The two line structures, formed of the contact paths 12 and 14 and one U-shaped conductor segment 16, 18 or 20, can have a galvanic connection, for instance, in which the line structures of both substrate plates 2 and 4, or superstrate plates or superstrate foils, have an electrical contact. Selectively, inductive and/or capacitive couplings are equally possible, in which case the line structures of the two substrate plates 2 and 4, or superstrate plates or superstrate foils, are merely located close together and are separated from one another by a dielectric and/or by the substrate plate 4.

The fundamental principle can be described using then following relationships:

In microwave technology, a phase shift (or propagation time) of a signal, described by the general equation $$x(t)=\approx\mathrm{Re}\{X\cdot e^{i\omega t}\},$$

can be realized by a line segment that has a length ranging from 0 to a few wavelengths. If a chronologically harmonic signal, described by the complex pointer $X_{ein}$, is located at the input of a microwave line (which in the ideal case is loss-free) of a length l, then the equation for the complex pointer of the output signal $X_{aus}$ is correspondingly $$X_{aus}=X_{ein}\cdot\exp(-j\cdot 2\pi\cdot/\lambda_g)=X_{ein}\cdot\exp(-j\cdot\mathrm{delta}\phi);$$

where $\mathrm{delta}\phi=2\pi\cdot/\lambda_g$.

$\lambda_g$ is the wavelength carried by the microwave line at a frequency f of $$f=\omega/(2\pi).$$

By varying the lengths l of the line, or of the signal propagation path, the phase shift or propagation time of the transmitted signals can thus also be varied.

FIG. 3 shows schematic views of one possible embodiment of a waveguide component 15 in a plan view (top) and side view (bottom), in the retracted position (on the left) and extended position (on the right) of the U-shaped conductor segment 16, 18 or 20. The conductor segment shown here has the shape shown in FIG. 2*b*. The contact paths 12 and 14 and the conductor segment 18 are embodied by microstrip conductor technology. In further exemplary embodiments, however, it is also possible to use one of the contact paths 16 or 20 in accordance with FIG. 2*a* or FIG. 2*c*.

The bottom side view shows the flat structure of the substrate plate 2 with planar contact paths 12 and 14 applied to it as well as the substrate plate 4, located parallel to it and embodied thinner here, with the planar U-shaped conductor segment 18 applied to it. A galvanic separation of the contact paths 12 and 14 from the U-shaped conductor segment 18 also exists, because of the substrate plate 4, located between them, of the U-shaped conductor segment 18. The exemplary embodiment shown thus also pertains to an inductive or capacitive coupling of the contact paths 12 and 14 to the conductor segment 18.

In the plan views of FIG. 3, angled portions of the contact paths 12 and 14, angled upward (in the case of contact path 12) and downward (in the case of contact path 14) by 90° in each case, and the inputs and outputs 11 and 13 can as a result be spaced apart farther from one another than in the embodiment of FIG. 1 in which the contact paths 12 and 14 are exclusively parallel to one another. In this way, the two external terminals are disposed on two opposed long sides of the substrate plate 2 and thus of the waveguide component 15, which allows a higher degree of miniaturization, with correspondingly finer terminals or terminal wires.

Figure 4:
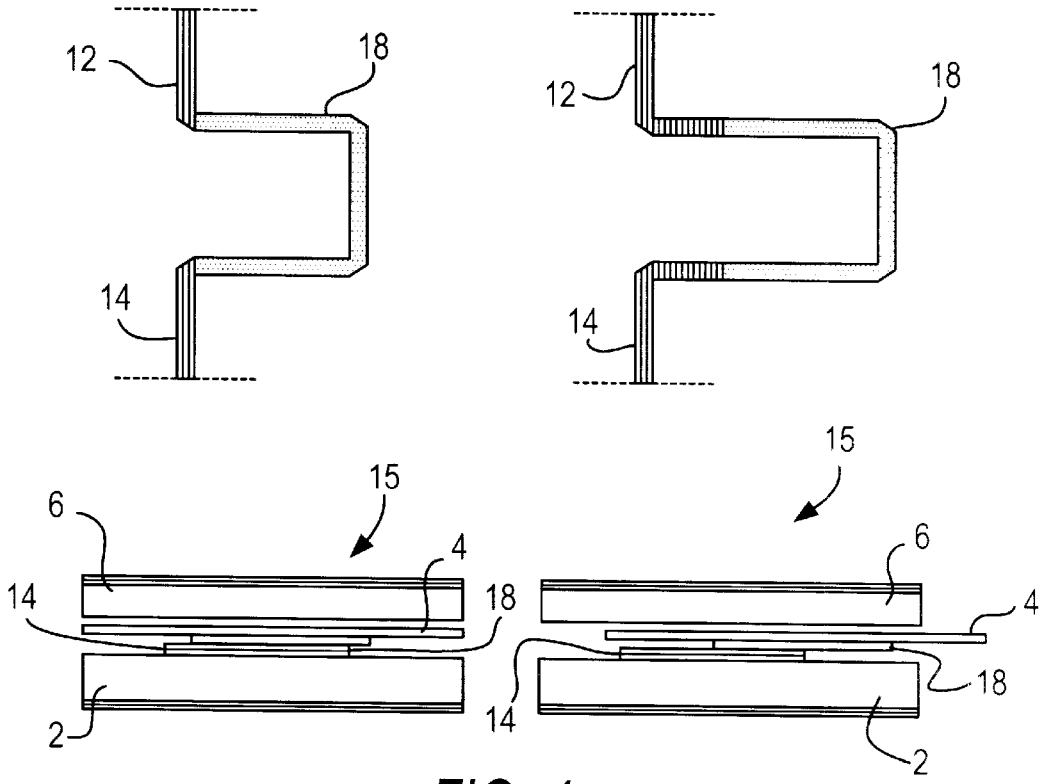
FIG. 4 is a schematic view of an embodiment employing triplate conduction technology.

FIG. 4 shows schematic views of a further possible embodiment of a waveguide component 15, in a plan view (top) and side view (bottom), in the retracted position (on the left) and extended position (on the right) of the U-shaped conductor segment 18. The waveguide component 15 is embodied here by so-called triplate line technology. The plan views correspond to those of FIG. 3. From the lower side view, the flat structure of the substrate plate 2 can be seen, along with planar contact paths 12 and 14 applied to it, as well as the substrate plate 4, parallel to the plate 2, with the planar U-shaped conductor segment 18 applied to it. Above this is a further substrate plate 6, which forms the upper termination of the sandwich assembly in so-called triplate line technology. The substrate plate 6 preferably has the same area at the base as the substrate plate 2 and is located parallel to it. In this case, the contact paths 12 and 14 are oriented directly toward the conductor segment 18, so that—once the desired total length is established—a galvanic coupling is possible between the conductor tracks 12 and 14 and the conductor segment 18.

Figure 5:
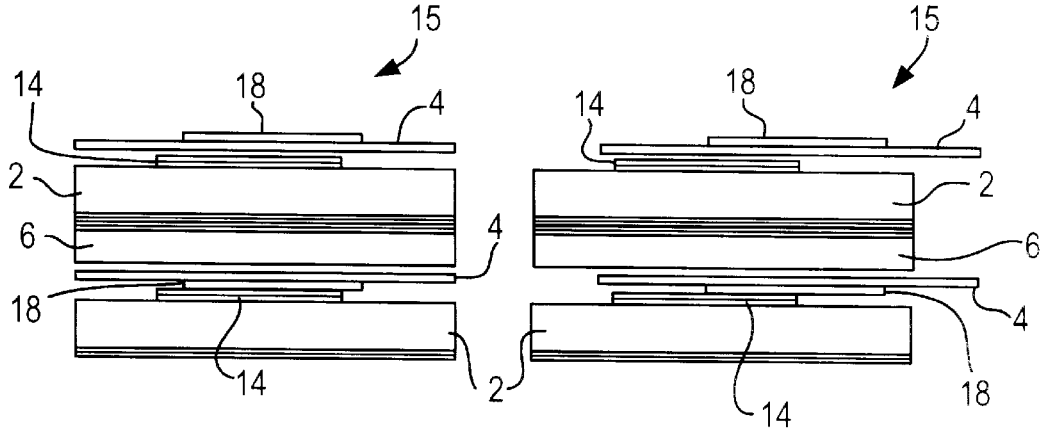
FIG. 5 is a schematic view of an embodiment employing multilayer technology.

FIG. 5 shows schematic views of a further possible embodiment of a waveguide component 15, in a plan view (top) and side view (bottom), in the retracted position (on the left) and extended position (on the right) of the U-shaped conductor segment 18. Here the waveguide component 15 is embodied as a multilayer line assembly (so-called multilayer technology). A first substrate plate 2 with contact paths 12 and 14 applied to it is followed, from the bottom up, by the displaceable U-shaped conductor segment 18 (or 16 or 20) with the associated substrate plate 4, and a further substrate plate 6, which is bordered by a further substrate plate 2. Located on it in turn are contact paths 12 (not shown in FIG. 5) and 14, followed by a substrate plate 4 with a U-shaped conductor segment 18. The two substrate plates 4 can either be displaceable independently of one another, or coupled to one another so that they can be displaced only simultaneously and in each case by an identical displacement distance in the longitudinal direction of the contact paths 12 and 14.

The assembly shown in FIG. 5 corresponds to a stack of the waveguide components 15 shown in FIGS. 3 and 4. In a concrete construction of a circuit arrangement that has the waveguide components 15, they can be disposed two- or three- dimensionally in a matrix.

What is claimed is:

1. An integrated waveguide component, comprising at least one planar microwave conductor having an input to which an input signal is applied and also an output outputting an output signal that is phaseshifted relative to the input signal and dependent on a length of the at least one microwave conductor, said at least one microwave conductor having at least one interruption point; a mechanically shiftable microwave conductor segment provided for said at least one interruption point; a substrate plate above which said microwave conductor is disposed; a further substrate plate above which said microwave conductor segment is disposed, so that said microwave conductor segment is shiftable parallel to said substrate plate by displacement of said further substrate plate to establish or adjust an effective length, spanning said interruption point of said microwave conductor segment in accordance with the desired phased shift between the input signal and the output signal, said microwave conductor segment being disposed on a side remote from said microwave conductor of said further substrate plate, so that said further substrate plate performs not only a carrier function for said microwave conductor segment but simultaneously a function of a dielectric for an inductive and/or capacitive coupling of said microwave conductor to said microwave conductor segment.

2. An integrated waveguide component as defined in claim 1, and further comprising a plurality of ground planes and displaceable adjusting planes disposed in layers one above the other.

3. An integrated waveguide component as defined in claim 2, wherein said ground planes and said displaceable adjusting planes are each formed as multi-layer conduction technology-produced planes.

4. An integrated waveguide component as defined in claim 2, wherein said plurality of ground planes and displaceable adjusting planes are disposed in layers one above the other in a multilayer structure.

5. An integrated waveguide components defined in claim 1, wherein said further substrate plate is a superstrate foil.

6. An integrated waveguide component as defined in claim 1, and further comprising conductive layers mounted as microstructures on said substrate plates.

7. An integrated waveguide component as defined in claim 1, wherein said microwave conductor has at least two planar contact paths, said microwave conductor segment being a substantially U-shaped microwave conductor sector and assigned to said at least two contact paths and also is displaceable longitudinally to said at least two planar contact paths.

8. An integrated waveguide component as defined in claim 7, wherein said at least two planar contact paths and said displaceable U-shaped conductor segment are composed of superconductors.

* * * * *